US006607764B1

(12) United States Patent
Keller

(10) Patent No.: US 6,607,764 B1
(45) Date of Patent: Aug. 19, 2003

(54) VENTABLE, MICROWAVE-SAFE FOOD PACKAGE

(76) Inventor: Karl Keller, Chilewise 11, 8197 Rafz (CH)

( * ) Notice: Subject to any disclaimer, the term of this patent is extended or adjusted under 35 U.S.C. 154(b) by 0 days.

(21) Appl. No.: 09/367,492

(22) PCT Filed: Dec. 18, 1998

(86) PCT No.: PCT/CH98/00546

§ 371 (c)(1),
(2), (4) Date: Oct. 22, 1999

(87) PCT Pub. No.: WO99/32373

PCT Pub. Date: Jul. 1, 1999

(30) Foreign Application Priority Data

Dec. 18, 1997 (CH) ..... 2909/97
Mar. 16, 1998 (CH) ..... 625/98

(51) Int. Cl.[7] ..... B65D 81/34
(52) U.S. Cl. ..... 426/107; 426/113; 426/118
(58) Field of Search ..... 426/118, 113, 426/107, 395, 234, 412

(56) References Cited

U.S. PATENT DOCUMENTS

| | | | | | |
|---|---|---|---|---|---|
| 2,850,391 | A | * | 9/1958 | Gunsberg | 426/113 |
| 3,432,087 | A | * | 3/1969 | Costello | 426/118 |
| 3,659,584 | A | * | 5/1972 | Doyle | 426/113 |
| 3,672,907 | A | * | 6/1972 | Hudson | 426/120 |
| 3,716,180 | A | * | 2/1973 | Bemiss et al. | 426/118 |
| 3,799,427 | A | * | 3/1974 | Goglio | 426/118 |
| 3,854,023 | A | * | 12/1974 | Levinson | 426/107 |
| 3,949,934 | A | * | 4/1976 | Goglio | 426/118 |
| 4,141,487 | A | * | 2/1979 | Faust et al. | 426/118 |
| 4,210,674 | A | * | 7/1980 | Mitchell | 426/118 |
| 4,261,504 | A | * | 4/1981 | Cowan | 426/118 |
| 4,358,466 | A | * | 11/1982 | Stevenson | 426/118 |
| 4,404,241 | A | * | 9/1983 | Mueller et al. | 426/118 |
| 4,419,373 | A | * | 12/1983 | Oppermann | 426/118 |
| 4,444,219 | A | | 4/1984 | Hollenstein | 137/246 |
| 4,529,089 | A | * | 7/1985 | Gasbarra et al. | 426/113 |
| 4,574,174 | A | * | 3/1986 | McGonigle | 426/118 |
| 4,640,838 | A | * | 2/1987 | Isakson et al. | 426/118 |
| 4,653,661 | A | | 3/1987 | Buchner et al. | 220/209 |
| 4,746,019 | A | | 5/1988 | Prater | 206/625 |
| 4,786,513 | A | * | 11/1988 | Monforton et al. | 426/118 |
| 4,834,554 | A | | 5/1989 | Stetler, Jr. et al. | 383/100 |
| 4,859,822 | A | | 8/1989 | Ragusa et al. | 219/10.55 |
| 4,865,854 | A | * | 9/1989 | Larson | 426/118 |
| 4,961,944 | A | * | 10/1990 | Matoba et al. | 426/118 |
| 4,987,280 | A | | 1/1991 | Kanafani et al. | 219/10.55 M |
| 4,987,380 | A | | 1/1991 | Ishikawa | |
| 5,263,777 | A | | 11/1993 | Domke | 383/103 |
| 5,326,176 | A | | 7/1994 | Domke | 383/103 |
| 5,388,910 | A | | 2/1995 | Koyanagi | 383/100 |
| 5,587,192 | A | * | 12/1996 | Beizermann | 426/118 |
| 5,806,703 | A | | 9/1998 | Grandi et al. | 220/203.15 |

FOREIGN PATENT DOCUMENTS

| | | |
|---|---|---|
| DE | 19 03 048 | 9/1969 |
| DE | 23 60 126 C3 | 6/1974 |
| DE | 25 49 855 | 9/1977 |
| DE | 27 32 661 | 2/1979 |
| DE | 31 25 496 C2 | 1/1983 |

(List continued on next page.)

*Primary Examiner*—Steve Weinstein
(74) *Attorney, Agent, or Firm*—Morgan, Lewis & Bockius LLP

(57) ABSTRACT

A package and a method for storing, venting, and heating consumable goods. The package includes a container defining an interior and a valve for venting gas during storage and heating. The container having sufficient stability to withstand heating conditions including microwave energy, vapor pressure, and a temperature of 150° Celsius. The valve has a well-defined, substantially constant flow resistance at vapor pressures and at a temperature of at least 150° Celsius developed in the interior during heating. Consumable goods are disposed in the interior of the container and comprise of at least two different fresh, raw foods that require different cooking times in water, and said consumable goods having an amount of water content of at least 30% by weight.

49 Claims, 3 Drawing Sheets

FOREIGN PATENT DOCUMENTS

| | | | | |
|---|---|---|---|---|
| DE | 91 08 222.6 | | 8/1991 | |
| DE | 41 22 077 | A1 | 1/1993 | |
| EP | 0 069 264 | | 6/1982 | |
| EP | 0 149 685 | A1 | 7/1985 | |
| EP | 0 198 362 | B1 | 10/1986 | |
| EP | 0 218 419 | B1 | 4/1987 | |
| EP | 0 303 428 A2 | A3 | 2/1989 | |
| EP | 0 462 767 | A2 | 6/1991 | |
| EP | 0 478 812 | A1 | 4/1992 | |
| EP | 0 597 741 | A1 | 10/1993 | |
| EP | 0 659 657 | B1 | 6/1995 | |
| EP | 0661219 | A2 | 7/1995 | |
| EP | 0 752 958 | B1 | 1/1997 | |
| EP | 0 795 482 | A2 | 9/1997 | |
| FR | 2629060 | | 9/1989 | |
| JP | 63-59838 | | 4/1988 | |
| JP | 63-67443 | | 5/1988 | |
| JP | 63-307085 | | * 12/1988 | ..... 426/118 |
| NL | 9 301 592 | | 4/1995 | |
| WO | WO 94/26605 | | 11/1994 | |
| WO | WO 96/31410 | | 10/1996 | |
| WO | WO 99/32372 | | 7/1999 | |

* cited by examiner

VENTABLE, MICROWAVE-SAFE FOOD PACKAGE

TECHNICAL FIELD

The present invention relates to a packaging in which food can be transported and/or sold which is intended for consumption in a heated state and is to be heated in the packaging.

The invention also relates to a method for cooking food which is at least partly fresh in a container in a microwave oven whereby during the heating process a vapor banking situation with excess pressure occurs within the container due to the water content of the food as well as the design of the container.

STATE OF ART

Amongst the known packagings of the previously mentioned type, in particular the boilable bag deserves to be mentioned with regard to dry food which can be preserved freshly in this condition for a relatively long time period and which is usually cooked in water prior to consumption, for example rice. In order to permit the hot water for blanching to reach the food, boiling bags mostly feature a multitude of small holes or are designed permeably in some other way.

Particularly in the field of convenience food a multitude of bags, dishes and other containers for moist food exist which are mostly enclosed in order to protect the food which is more perishable due to its inherent moisture from external influences, to keep the food fresh, to protect it from dehydration or simply to prevent any liquid spillage. Regularly in this connection the foodstuffs are ready-cooked so that they only need to be heated in a bain-marie, a baking oven or a microwave oven, for instance. This is called "regenerating" in contrast to cooking food from its fresh state. A prior opening of the packaging by cutting it open or removing a cover for instance, is mostly required in this-connection and therefore also mandatory.

In relation to the above mentioned method it is known that fresh food with an inherent water content such as vegetables has to be cooked in a microwave oven using cooking utensils which are especially designed for this purpose. The known cooking utensils are however unsuitable as packaging in which food can be sold and/or transported and would pricewise be too costly to be used for this purpose.

Moist food cannot be cooked in open containers using a microwave oven, or it can at least not be cooked in a microwave without further precautions. Particularly vegetables tend to dehydrate in an open container. Even the tearing of meat fibers can occur when using meat.

DESCRIPTION OF THE INVENTION

According to the invention as characterized in claim 1 a packaging is provided in which food of the aforementioned type can be transported and/or sold, said packaging is characterized in that it consists of a microwaveable material, which by taking into consideration the water content of the food, an amount of liquid is contained in the packaging such that the food can be heated in the vapor atmosphere developing inside the packaging using a microwave oven, and that the packaging is provided with means for limiting and/or reducing the vapor pressure which builds up inside the packaging during rapid heating in the microwave oven.

Using the aforementioned means for limiting and/or reducing the vapor pressure, more preferably it is also possible to use the packaging for fresh foods and actually cook these in a microwave oven although for this, depending on the specific consistency of the food, a not inconsiderable amount of energy or power is possibly required. The means denoted however ensure even in this case that the packaging is not destroyed by the vapor pressure which builds up even during rapid heating in a microwave oven, and by the resulting possibly fairly high vapor temperature. The packaging according to the invention is therefore especially designed and suited for the preparation in minutes of food contained in the packaging from the fresh state to its cooked condition, being ready for consumption, using a microwave oven.

Due to the vapor pressure which builds up and is higher than the ambient pressure, and the temperature thereby increased beyond 100° C. the cooking process is effected rapidly and gently. For example, a mixture of fresh vegetable pieces can be cooked ready for consumption within approx. 3 minutes in a 750 W microwave oven. Surprisingly in this connection even a type of plateau phase with respect to the cooking condition eventuates with regard to several commonly used vegetables such as zucchini which means that the said vegetables remain in a practically optimal cooking condition for a certain time period and that other vegetables which cook slower, such as potatoes, have time to reach the desired cooking level, an effect which for example does not occur when the same vegetable varieties are cooked in water or are vaporized in a pan. Using the traditional methods of preparing these foods the various vegetables are mostly cooked in graduated time intervals in order to compensate for the different cooking times required, and are additionally mostly cut into different sizes. As an example, for a typical traditional ratatouille, carrots are cut 0.5 mm thick, cauliflower and broccoli 0.7–0.8 mm, onions and leeks 10 mm and pepper, zucchini or eggplants 15–20 mm. For the preparation in the packaging according to the invention the very same vegetable varieties can practically be cut to equal thickness, for example 10 mm, with a variation in cut depth of only 20% due to the aforementioned plateau effect. An equal size of the various vegetables is optically more appealing than the method used traditionally.

A piece of fresh chicken breast weighing 200 g can also be cooked within only 3½ minutes using the packaging according to the invention. A piece of fresh fish fillet of equal size requires just one minute.

In comparison with traditional cooking methods the foods, particularly vegetables, prepared according to the present invention also retain their natural aroma to a greater extent.

The advantages achieved by using the invention can furthermore be considered in that

- no additional cooking utensils are required and therefore the amount of dish washing is reduced;
- special cooking utensils suitable for rapid cooking in a microwave oven, like the aforementioned, are not required to be purchased and stored readily available in the kitchen thereby taking up storage space;
- the packaging, particularly if this represents a dish, can also be used as a plate substitute;
- no special knowledge is required for the preparation;
- the food contained in the packaging can be cooked ready for consumption in a matter of minutes;
- the preparation can practically be carried out without adding any fat or additional liquids provided that the food has a sufficiently high inherent water content of at least 30%;

because of the possibility of preparing food in its fresh condition the said food shows higher quality in terms of consistency and nutrient content in comparison to commonly used ready-cooked convenience food;

the cooking or regenerating can also be done in a baking oven or bain-marie if for example a microwave oven is not available, whereby naturally the possibility exists to take the food out of its packaging prior to preparation and to prepare it the conventional way in commonly used cooking and frying utensils.

The means for limiting and/or reducing the vapor pressure are preferably designed in such a way that they enable the vapor which is building up in the packaging during the rapid heating process per unit of time in a microwave oven to escape comparatively slower from the packaging into the ambient atmosphere mainly due to the flow resistance of the said means. These means can for example employ a valve which opens preferably automatically to the outside, located in a wall of the packaging, or just a comparatively small ready-made and therefore well defined hole. In the latter case it is preferable to cover the hole for the sale and/or transport of the foodstuffs with an adhesive label which can be removed by the consumer prior to heating in a microwave oven. The adhesive label has to be sufficiently adhesive so that it cannot become detached due to any fluctuations in pressure occurring within the packaging during transport and storage. A valve that opens automatically offers the advantage of greater user safety compared to a hole covered by an adhesive label. For example, a valve as used under the name of WICOVALVE for filling bags for roasted coffee made by the company Wipf AG in CH-8604 Volketswil, and which opens to the outside at an only marginally excess pressure less than 5 mb, whereas it provides a good seal in the opposite direction, is suitable. After the valve has opened due to internal excess pressure it closes again automatically when the excess pressure has fallen to a value of 0.5 mb. These valve properties also ensure that the excess pressure which builds up during the heating phase in the packaging can again be reduced rapidly and completely after the heating process, and a possible deformation of the packaging can at least largely return to its original shape largely so that the packaging while still hot can be opened without any risk immediately after its removal from the microwave oven.

In terms of the selection and dimensioning of the aforementioned means for limiting and/or reducing the vapor pressure as well as their flow resistance the said means naturally have to be adapted to the size and stability of the packaging, to type, properties, water content and reaction to cooking of the contents in the packaging as well as to the calorific output of the microwave oven. Another influential factor is the size of the packaging in relation to the volume of the contained food. Preferably all these parameters are matched and optimized for a specific product whereby, furthermore, preferably the same packaging and pressure control means are used for different food types, if possible. The preferable heating capacity to be selected is such that it can be set directly using standard microwave ovens. Microwave appliances used in a household situation offer for example 600 W or 750 W. Microwave appliances used in a commercial situation can be operated to up to 1500 W. The easiest way is to vary the cooking time from meal to meal.

In order to conclusively predetermine a cooking time for a particular recipe to achieve a certain desired result (for vegetables for example al dente or à point) the remaining parameters need to be kept within narrow boundaries. This applies in particular to the means utilized for limiting and/or reducing the vapor pressure. The previously mentioned valve made by the company Wipf has again proven itself to be suitable because its opening pressure as well as its flow resistance are very well defined. The valve has a dimensionally stable valve gate in which a small membrane is securely situated. Inside the bottom part of the valve body, to be more precise inside the valve face area provided there, several well defined holes are incorporated which are covered by the said membrane. The holes are surrounded by ring-shaped grooves which serve as the intake for a sealing oil. The membrane is secured in a center part of the valve face area using an armature component exerting a certain pre-stress. For a sufficiently accurate specification of the cooking time, for example, so-called foil valves might be too inaccurate, said foil valves consisting of two foil walls of the packaging which are jig welded together and possibly additionally equipped with rippled embossing in such a way that a ventilating channel equipped with baffles results. The internal excess pressure necessary for this channel to open is not easily controllable and may also not be much below 20 mb particularly when it is considered that the foils cannot be too thin due to stability problems. In addition, a sufficiently safe and hygienic seal is at least difficult to realize using such valve designs. For the aforementioned valve made by the company Wipf as well as for other known valves used for food packagings, the presence of a sealing oil plays a not inconsiderable role in order to provide a safe seal. Finally, foil valves of the previously mentioned type cannot simply be placed where they, on the one hand, do not interfere with the filling and sealing of the packaging, but on the other hand are located in the most optimal way for the cooking process.

It becomes apparent how susceptible the selection of the correct flow resistance of the pressure control means is, if for example two valves instead of just one of the described type are used. Because of this the cooking time increases not inconsiderably due to the lower excess pressure building up inside and the lower temperature thereby achieved so that for example zucchini do not reach their optimal cooking point within a time period set for one valve. If, on the other hand, the cooking time was predetermined correctly for two valves but packaging with one valve were to be used, the zucchini would already be overcooked on reaching the end of the longer time span.

Vice versa it is also obvious from this, that the selection of the optimal cooking time for a particular recipe can itself be a critical factor. However, by having designed the packaging according to the invention as packaging in which food can be transported and sold it is possible on the part of the manufacturer to determine the optimal cooking time for a particular recipe while taking into consideration all remaining factors such as the heating capacity, physical properties of the selected packaging etc in preliminary tests and indicate this on the packaging so that the end-user is not left searching for the correct settings.

The magnitude of the flow resistance of the pressure control means is eventually also affecting the moisture content of the pre-prepared vegetables. If the cross section of flow is too large more vapor is allowed to escape and at the same time a longer cooking time is necessary due to the lower temperature and lower pressure. Because of this undesirable effect, at least superficial dehydration of the food can eventuate.

The packaging is preferably designed as disposable packaging for once only use and should therefore be economical in terms of manufacturing and material usage. This can be especially achieved by utilizing a commonly used thin-walled synthetic material, for example in the shape of molded plastic dishes sealed by a cover foil, or just by bags made from commonly used synthetic foil or similar materials.

Naturally the packaging material and the packaging as a whole have to withstand the excess pressure developing during the vapor banking phase as well as the temperatures thus reached. Towards the end of the cooking time temperatures of up to 150° C. an excess pressure of up to 3 bar can also be reached. The suitability of the material to be used in microwave ovens has been mentioned earlier.

Under no circumstances is the material permitted to melt under the influence of high temperatures or change in any other negative way for the food. It also has to be sufficiently dimensionally stable so that the packaging cannot expand to the ceiling or walls of the cooking displacement of a microwave oven which is used in accordance with the invention, and cannot virtually fill out this cooking displacement. In this connection the means for limiting and/or reducing the vapor pressure could for example come in contact with a wall or the ceiling of the cooking displacement and therefore cause a hindrance for the vapor emission and possibly a resulting bursting of the packaging. For example, microwave appliances designed for a household situation only the material offer a usable height of less than 20 cm of the cooking displacement.

The material should furthermore be as elastically reversible as possible so that the packaging does not deform in a permanent way during the heating and excess pressure phase, and possible deformations can return to their original size again as completely as possible. This demand is above all important for saucer-type containers which may possibly be used as plate substitutes whereby in this case the bottom part is of utmost importance.

At least the bottom of the saucer-type container should return as evenly as possible after the heating and pressure load so that the container stands evenly on a surface and does not wobble. A suitable shaping of the saucer-type container can additionally counteract an excessive deformation and/or support a return to the original shape. The use of fluting of the side walls achieves for example a type of advantageous concertina effect.

In terms of temperature stability polypropylene or CPET are suitable materials, for example. The melting point of polypropylene occurs at around 160° C., and this material can be heated to 110° C. continuously. Short-term even temperatures of up to 140° C. are possible. The melting point of CPET occurs at approx. 264° C. but it is substantially less elastic than polypropylene and also does not return as well as polypropylene back to its original shape after the heating and pressure load. Customary polyethylene otherwise mainly used for food packaging is hardly suitable because even the high density polyethylene HD-PE reaches its melting point at 135° C., and therefore the short term and especially the long term stability under load are not located in the range required for the present invention.

In order to be able to withstand the heat and pressure the material that is chosen should preferably not be too thin. For example, for a dish made of polypropylene wall thicknesses in the range between 500 $\mu$m and 1000 $\mu$m are suitable. Below 500 $\mu$m it becomes critical with respect to stability. Above 1000 $\mu$m the deformations which occur during the vapor banking phase no longer return to size sufficiently. For bags such as bags with a solid bottom part, the wall thicknesses should still be 100 $\mu$m to 200 $\mu$m whereby these can possibly be additionally reinforced if polypropylene is being used by laminating them together with a possibly pre-stretched foil with limited extensibility made from different materials such as nylon.

In order to enable an impervious packaging seal after the filling of the packaging in a simple, rational and commonly used way at least a portion of the material should be sealable, i.e. it should be able to be jig welded by applying pressure and heat. Provided that this requirement appears to be in contrast to the remaining requirements, especially in regard to compression, resistance laminates consisting of several layers which offer different properties can be used, for instance. A laminate that is suitable as a cover foil for the sealing of dishes made of polypropylene is one example which is manufactured from a 75 $\mu$m polypropylene foil and a 12 $\mu$m polyester foil whereby the polypropylene foil ensures the weldability and the polyester foil laminated to it provides sufficient stability. In order to be of sufficient stability a pure polypropylene foil would have to be made of such a thickness that it would not be sealable, or at least not by using customary heat sealing methods and devices. Instead of laminating additional foils to it, sealable foils could also be stabilized in different ways, for example by joining them to network structures or similar.

The usage of a material, at least in part, which is as transparent as possible is preferred for the packaging, particularly for example for the cover foil of dishes, so that the customer purchasing the packaging can recognize the contents easily.

Finally, the materials used for the packaging should also be as gastight as possible.

For the desired vapor atmosphere to develop inside the packaging during the heating process the food should have a water content of at least 30%, preferably even 40%.

The food is preferably pre-seasoned ready for consumption so that it can be consumed immediately after the heating process in the microwave oven. The "seasoning" includes the commonly used flavors but also the addition of, for example, a small amount of herb butter, a sauce or similar. Meat or fish pieces are preferably covered with emulsified seasoning, a marinade containing oil and fat or similar which also protects the said pieces from becoming stringy when heated rapidly in a microwave oven.

BRIEF DESCRIPTION OF THE FIGURES

In the following the invention shall be explained in more detail using embodiments in connection with the figures. In.

METHODS FOR THE EMBODIMENT OF THE INVENTION

Figure 1:
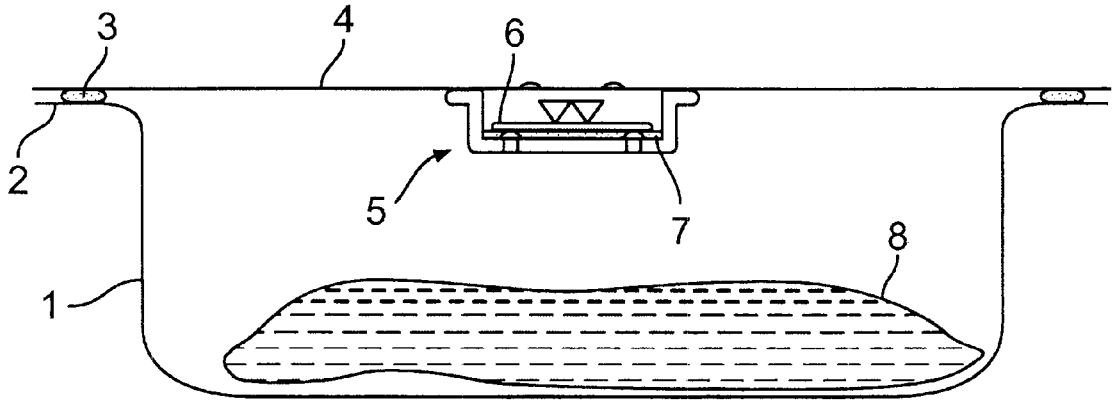
FIGS. 1 and 1A a first embodiment of the packaging according to the invention is shown which is based on a dish equipped with a valve.

In FIG. 1 the number 1 denotes a molded flat dish of rectangular, square or also round ground plan shape made of a thin synthetic material such as 600 $\mu$m polypropylene, for instance. Onto the circular edge 2 of the dish 1 a cover foil 4 for which e.g. 12 $\mu$m polyester laminated against 75 $\mu$m polypropylene can be used, is jig welded by means of a circular jig weld seam 3. A valve 5 of the aforementioned type, i.e. a WICOVALVE valve made by the company WIPF which features a membrane 6 on a sealing surface 7, is incorporated into the cover foil 4. For better clarity the valve 5 is shown excessively large and also excessively thick. In reality the WICOVALVE valves made by WIPF only have a diameter of 1.5 cm and a thickness of 3 mm, for example. Inside the dish 1 a food type 8 is shown, in this example in the shape of a fresh and still raw chicken breast, featuring a certain inherent water content.

The dish according to FIG. 1 can for example have a size of 20 cm×13.5 cm in which a circular edge of 1 cm in width is included. The height of the dish can for example be 4 cm or 6 cm.

Figure 1A:
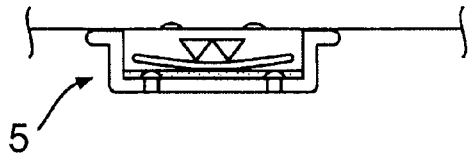

The valve 5 is designed as a one-way valve. In FIG. 1 it is shown in its closed state in which the membrane 6 is in contact with the sealing surface 7. As soon as any excess pressure builds up inside the dish the membrane 6 separates itself from the sealing surface 7 as shown in FIG. 1*a*). The valve is then directionally permeable from the inside to the outside. In the reverse direction, i.e. excess pressure occurring on the outside or negative pressure inside, the valve is unable to open. It therefore prevents the penetration by ambient air, impurities or similar. It is preferable that the valve already opens at an excess pressure of 3±1 mb inside the dish and closes again automatically when the internal excess pressure has fallen to approx. 0.5 mb. Also another valve could be used which for example does not open until around 10 mb or even higher. The valve opening itself is relatively small and is approx. only 1 $mm^2$. It therefore creates a comparatively high flow resistance.

Due to the previously described embodiment the packaging can be used according to FIG. 1 directly as packaging in which food can be sold and/or transported whereby its transport and sale should preferably be conducted in chilled condition for the purpose of preserving the content of the packaging. A normal cooling to a conventional refrigerator temperature is thereby completely sufficient. Deep- or quick-freezing would on the other hand also be conceivable and possible.

The packaging shown in FIG. 1 can now be, as it is, i.e. more preferably without being cut open, put in a microwave oven for the purpose of cooking the food 8. For this reason the packaging is preferably provided with instructions for use and preparation adapted to its content by which the heating capacity of the microwave oven as well as the required cooking time is specified, for instance.

As a result of the heating a portion of the moisture contained in food type 8 is vaporized, and the pressure inside the packaging rises. The valve 5 may therefore open more or less immediately but the developing vapor cannot escape from the packaging at the same rate as it is built up by the heating process inside the microwave oven (if the setting on the microwave is accordingly fixed), due to the previously mentioned comparatively high flow resistance of the valve opening. Therefore a vapor banking situation develops inside the packaging which sees the temperature rise above 100° C. and the pressure increase above the ambient pressure. This vapor banking situation is desirable because the cooking process of food varieties which are fresh and contain an inherent moisture content such as the tender chicken breast 8 used in the present example, is under such circumstances effected quickly and gently within a matter of minutes. The valve 5 has in this connection therefore the function of limiting and/or reducing the excess pressure inside the packaging.

After the heating phase, i.e. after the completion of the time span set on the time switch of the microwave oven, when new vapor is no longer created in any considerable quantity, the excess pressure inside the packaging is reduced by the valve 5. In order to open the packaging virtually immediately without any risk and in a heated state for the purpose of removing the cooked food it is advantageous if the valve permits the reduction of excess pressure as extensively as possible before it closes again. The WICOVALVE valves preferably used made by WIPF offering an opening pressure of just 3±1 mb as mentioned, do not close until the internal excess pressure reaches approx. 0.5 mb. The increasing cooling of the packaging and its content also work towards a reduction in pressure.

At least in the previously described embodiment and size and through the use of the aforementioned materials, the packaging shown in FIG. 1 is sufficiently pressure and dimensionally stable and returns to its original shape after the heating process. For the return to the original shape it is once again important that the excess pressure inside the packaging can rapidly be reduced after the heating process. The circular jig weld seam 3 on the edge of the dish is critical with respect to the pressure stability. In this regard a contour welding is favored by which the cover foil 4 is not jig welded completely to the edge but only to a narrow strip of eg. 5 mm in width which is also a certain distance away from the inner edge of the dish, as is also shown in FIG. 1. In contrast to all-over welding, contour welding can be performed utilizing customary heat sealing devices and also using locally higher pressures as well as locally higher temperatures. In this connection a level flatness of the container edge is also important.

The stability of the dish according to FIG. 1 and its capability to return again to its original form after the heating process and pressure load can possibly still be increased by implementing ribs into the area of the side walls or the bottom of the packaging. A slightly drawn bottom part in relation to the side walls additionally improves the dimensional stability and therefore the durability of the container. Local reinforcements which are too solid should on the other hand be avoided because these can cause permanent deformations. Dishes of the previously described type can easily be manufactured using swedging techniques. In this connection it is especially important to be careful that the material is not being stretched too thinly especially in the corner areas and that as a result weak points are introduced.

Finally, it shall not remain unmentioned that inside the packaging according to FIG. 1 a not inconsiderable negative pressure (of up to several hundred mb) can also develop after the cooling phase (following the preparation in a microwave oven) or simply because of variations of the ambient pressure (atmospheric fluctuations, moving the packaging to higher altitude levels, air transportation or similar) whereby the dish should not show considerable and permanent deformations.

The flat container according to FIG. 1 can be used as an eating dish immediately after the removal of the cover foil. Due to its inherent rigidity the dish protects the food contained inside from external pressure loads even while the food is being transported and/or sold which makes it possible to also arrange the food varieties from the outset in an optically appealing way and possibly even decorate them.

The valve 5 may not necessarily be positioned in the cover foil. It could also be located in one of the walls of the dish 1 whereby though the seal-in process could possibly be more difficult to manage. Instead of only one valve several could be provided, or one or more valves could be combined with other means, for example such as described in the following. For the purpose of separating its content the packaging could also be divided into several chambers separated from each other whereby each would then have to be provided with pressure control means.

Figure 2:
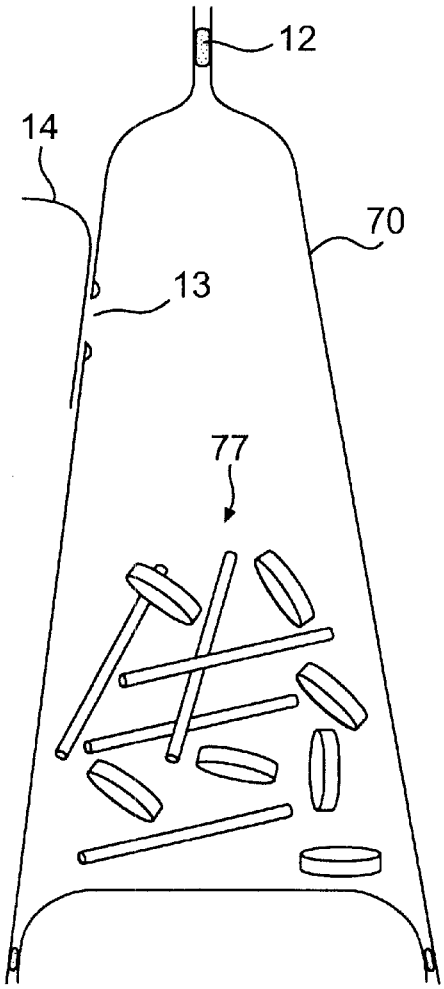
FIG. 2 a second embodiment is shown which is designed as a bag with a solid bottom part which in turn is equipped with a small hole that is covered by an adhesive label.

FIG. 2 shows an embodiment in which a bag 10, in this case constructed as a flat-ended bag, is used instead of the dish 1. The material for the bag is for example 15 μm oriented nylon laminated to 150 μm polypropylene (PP specifically with gas inhibitor). The oriented nylon provides the required dimensional stability. The bag is filled with a mixture 11 of different fresh vegetables such as zucchini, carrots, cauliflower, pepper or similar whereby some vegetable julienne strips as well as slices are shown for illustration purposes. After the filling process the bag is closed by jig welding at 12.

In FIG. 2 in place of a valve, merely a small hole 13, shown again excessively large for illustration purposes, is located in the wall of the bag 10, said hole being covered and sealed by a detachable adhesive label 14. The adhesive label 14 prevents the ambient air or impurities penetrating the bag 10 through the hole 13. This label is removed prior to the preparation of the contents of the bag 11 in eg. a microwave oven. The hole 13 then performs the same function during the heating phase as the valve 5 in FIG. 1, i.e. it is limiting and/or reducing the excess pressure but has been selected sizewise in such a way that the described vapor banking situation can develop. The hole 13 obviously should have a fairly precisely defined size and should be designed such that it does not increase in size during the excess pressure phase due to tearing.

The flat-ended bag in FIG. 2 is also especially suited as a boilable bag if, as mentioned previously, the specific preparation method according to the present invention shall not or cannot be used. With regard to such an alternative usage the use of a valve instead of a hole covered by an adhesive label would perhaps be more advantageous as the adhesive label could possibly come off in a bain-marie during the heating process.

Figure 3:
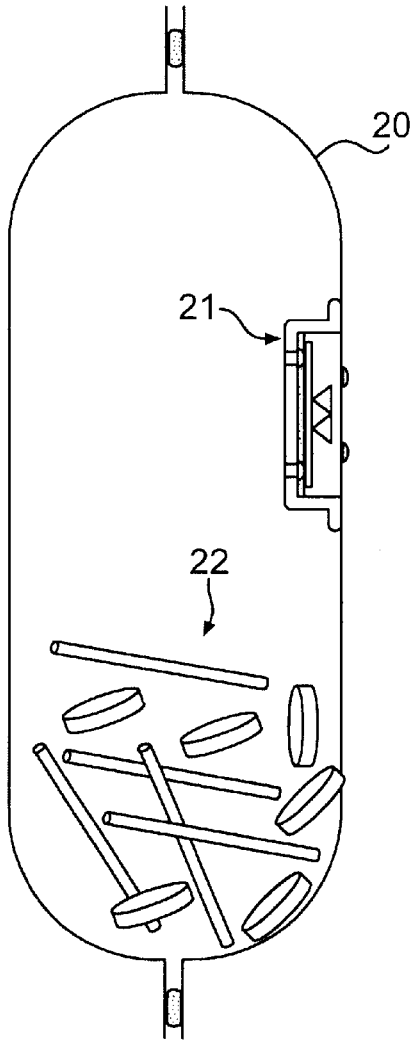
FIG. 3 a third embodiment which essentially consists of a simple bag which again is equipped with a valve.

The packaging according to FIG. 3 consists of a simple bag 20 jig welded up on both sides which is equipped with a valve 21 of the type of valve 5. The bag 20 is for example again filled with a mixture of vegetables 22. This embodiment is preferable for larger filling quantities and therefore for use in the commercial field where as a rule more powerful microwave ovens are also available. For professional use the suitability of the packaging as packaging for vending purposes is therefore not as important. In this regard the packaging types according to FIGS. 1 and 2 are more advantageous.

The packaging types in FIG. 1 (dish) and FIG. 2 (flat-ended bag) can be placed steadily on a surface due to their floor area or bottom components and can therefore be presented in a more appealing way for example on a store shelf. Flat dishes according to FIG. 1 can also be stacked on top of each other. In addition, a possible and preferable orientation results from the shape of the packaging according to FIGS. 1 and 2, i.e. that the packaging types, exceptions excluded, are mostly placed on their bottom part and are also transported and sold like that. Provided that in this connection, as shown in FIGS. 1 and 2, the pressure control means are not positioned in the bottom part of the packaging but at a higher location with some clearance from the bottom part, there is also no risk that free liquid possibly contained inside the packaging can leak. Thus, the pressure control means or the valve are then not continuously in contact with the content of the packaging which could affect their functionality. Incidentally under normal circumstances (no excess pressure inside the packaging) even the excess pressure of 3–5 mb which the preferably used valve made by WIPF holds prior to opening up is already sufficient to keep an even larger amount of free flowing liquid with a liquid column of up to 5 cm inside the packaging if this should turned upside down even once. Such a large amount of free flowing liquid should however represent the rare exception. For the simply structured bag according to FIG. 3 it can be ensured during heating in a microwave oven that the valve is placed in an upright position in order to avoid any spillage of liquid built up during the heating process and to ensure free emission of the developing vapor.

Finally, the pressure control means should also be arranged in such a way that they do not interfere with the filling and the sealing of the packaging. For the packaging shown in FIGS. 1–3 this requirement has also been met.

Figure 4:
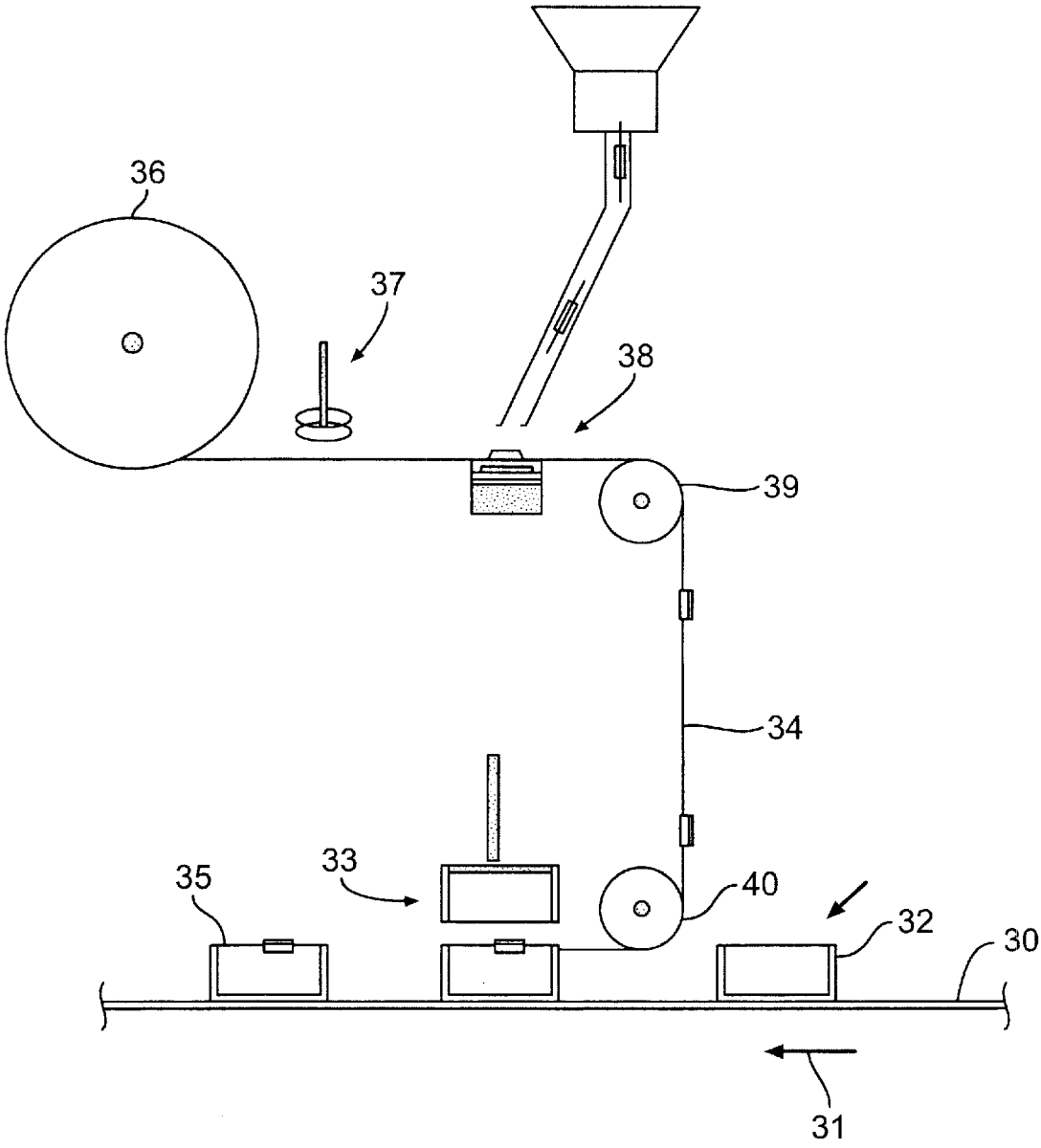
FIG. 4 a manufacturing plant for the manufacture of packaging according to FIG. 1.

FIG. 4 shows a manufacturing plant for the manufacture of packagings according to FIG. 1. Ready-made dishes 32 already filled with the required food(s) are transported on a conveyor belt 30 in the direction of the arrow 31 and provided with a cover foil 34 in the sealing station 33. An already jig welded packaging is denoted by number 35.

The cover foil 34 is drawn off a continuous roller 36 and then pressed at 37. In another station 38 valves of the type represented by valve 5 or 21 are then incorporated in the holes punched in the cover foil at 37. Via deflection rollers 39 and 40 the thus prepared cover foil finally reaches the sealing station 33 where it is jig welded to the dishes 32 and also cut into sections.

Examples of Recipes

In the following several examples of recipes are listed together with their appropriate microwave heating capacities and cooking times whereby the individual recipes were tested using the packaging according to the invention which were each equipped with a WICOVALVE valve of the company Wipf (loc cit).

| Recipe | Time/Power rating |
|---|---|
| Fresh tender chicken breast, 100 g<br>mixture of fresh vegetable julienne, 30 g<br>emulsified seasoned mixture, 5 g | 3 min 30 sec/750 W |
| Salmon fillet, fresh, 100 g<br>mixture of fresh vegetable julienne, 30 g<br>emulsified seasoned mixture, 5 g | 3 min/750 W |
| Vegetable mixture of fresh carrots, zucchini, coloured pepper, leak, cauliflower and broccoli, all chopped coarsely, 200 g<br>seasoning cube, 16 g | 3 min 30 sec/750 W |
| Fresh tender chicken breast "Royal", on a bed of mixed fresh vegetables (carrots, zucchini, coloured pepper, leak, cauliflower and broccoli) | |
| 265 g | 3 min 30 sec/750 W |
| 300 g | 4 min 30 sec/750 W |
| 300 g | 4 min 30 sec/600 W |
| Pot au Feu with carved skinless fresh chicken leg, fresh vegetables and a little chicken broth | |
| 275 g–290 g | 4 min 30 sec/750 W |
| 275 g | 5 min/600 W |
| Pre-grilled tender chicken breast, not cooked in the | |

-continued

| Recipe | Time/Power rating |
|---|---|
| center, on a bed of lightly cooked ratatouille | |
| 250 g–275 g | 4 min/750 W |
| 275 g | 4 min 30 sec/600 W |
| Tender fresh chicken wing, grill flavoured seasoning, | |
| 150 g–167 g | 3 min 30 sec/750 W |
| 150 g | 4 min/600 W |
| Tender chicken breast roulade: fresh tender chicken breast, wrapped in Italian ham, eg. Pancetta, and covered in an emulsified seasoned mixture | |
| 171 g–190 g | 3 min 30 sec/750 W |
| 190 g | 4 min/600 W |
| Skewers ("Indian style") with fresh tender chicken breast, pepper and onions rolled in a curry mixture | |
| 190 g | 3 min/750 W |
| 190 g | 3 min 30 sec/600 W |
| 230 g | 3 min 30 sec/750 W |
| Fresh tender chicken leg rolled in grill-flavoured seasoning with seasoned prefried potato cuts or wedges | |
| 251 g | 3 min 30 sec/750 W |
| Fresh salmon filet, 100 g mixture of fresh vegetable julienne, 30 g emulsified seasoned mixture, 5 g | |
| 170 g–185 g | 3 min/750 W |
| 220 g | 3 min 30 sec/750 W |
| 220 g | 4 min/600 W |
| King filet of cod on a bed of lightly cooked vegetable ratatouille with a Herbes de Provencale mixture | |
| 250 g–288 g | 3 min/750 W |
| 250 g | 3 min 30 sec/600 W |
| Fresh rare salmon coated in an emulsified seasoned mixture | |
| 170 g–180 g | 3 min/750 W |
| 170 g | 3 min 30 sec/600 W |
| Shrimps, calamari and cod pieces with olives and a mixture of fresh vegetables Brunoise style in olive oil and herbs | |
| 267 g–290 g | 2 min/750 W |
| 267 g–290 g | 2 min 30 sec/600 W |
| Filet of king cod on a bed of mixed vegetables (carrots, zucchini, coloured pepper, leak, cauliflower and broccoli) | |
| 240 g–250 g | 3 min/750 W |
| 240 g–250 g | 3 min 30 sec/600 W |
| Skewers with pieces of fresh salmon, pepper, leak and onions coated in an emulsified seasoned mixture | |
| 120 g | 1 min 15 sec/750 W |
| 160 g | 1 min 30 sec/750 W |
| 160 g | 2 min/600 W |

In conclusion several vapor temperatures are also listed in table format as they were measured inside a packaging according to FIG. 1 of the aforementioned dimensioning as well as with a height of 6 cm and at a power level set at 750 W. In line 1 a Wicovalve type valve with 3 mb opening pressure made by the company Wipf was used which will be denoted as standard valve in the following. The values in line 2 were achieved using two standard valves whereas the values in line 4 were achieved using three such standard valves. The results in line 3 were achieved using a valve which was essentially of identical design to the valve made by Wipf but which offered a higher opening pressure of between 5 and 10 mb (approx. 7.5 mb) and also had a slightly larger valve opening. The 2 minutes equate for example for carrot slices to the lower useful cooking time whereas the 4 minutes equate to the higher useful cooking time.

| | 2 Minutes | 4 Minutes |
|---|---|---|
| 1 | T = 116° C. | T = 149° C. |
| 2 | T = 104° C. | T = 143° C. |
| 3 | T = 104° C. | T = 116° C. |
| 4 | T = 104° C. | T = 110° C. |

The table shows that the number or type of valves used do not have such a critical effect in respect to short cooking time periods that they would have in respect to longer cooking time periods. The really high temperature above 140° C. and the associated relatively high pressures can however only be reached using the longer cooking time period and just one or a maximum of 2 of the aforementioned standard valves.

With regard to the cooking process a shorter cooking time with a high temperature and high pressure is preferable compared to a longer one with a lower temperature and pressure, on the hand because the cooking process is thereby effected in a more gentle way and on the other hand because the cooking process thereby also naturally requires less time being of advantage the consumer.

The enlargement of the total outlet diameter accompanying the use of several valves or of a valve offering a larger valve opening, for the developing vapor also has the result that more vapor and therefore moisture can escape from the packaging which is seen as a disadvantage with respect to dehydration of the food. The said food should naturally be prepared without adding external liquid if this is possible. Therefore in this connection an embodiment featuring means for limiting and reducing pressures which function in a similar way to just one or two standard valves in the sense defined here, is also preferable.

The above table can on the whole be used as an instruction table for a suitable dimensioning of the packaging and the used valve.

What is claimed:

1. A microwave-safe package for storing and heating consumable goods in a microwave oven, comprising:

a microwave-safe container defining an interior, said container having sufficient stability to withstand heating conditions including microwave energy, vapor pressures of up to 3 bar, and a temperature of 150° Celsius;

a one-way microwave-safe valve for venting gas from the interior, said valve capable of venting excess pressure during storage and during heating to prevent package rupture or damage, wherein said valve has a well-defined flow resistance and a dimensionally stable valve gate at vapor pressures of up to 3 bar and at temperatures of up to 150° Celsius developed in the interior during heating;

said one-way valve configured to enable the vapor pressure which builds up in the package during microwave heating to escape comparatively slower from the package into the ambient atmosphere primarily due to the flow resistance of said valve such that a vapor banking situation develops inside the package such that the temperature rises above 100° Celsius and the pressure increases above ambient such that the cooking of the consumable goods occurs quickly and gently; and consumable goods disposed in the interior of the container, said consumable goods comprising of at least two different fresh, raw foods that require different cooking times in water, and said consumable goods having an amount of water content of at least 30% by weight.

2. The package according to claim 1, wherein storage includes transportation and sale portions of time.

3. The package according to claim 1, wherein said valve comprises a rigid valve body and a membrane secured to the rigid valve body.

4. The package according to claim 1, wherein the consumable goods are heated by vapor pressure and by absorption of radiation by water contained in the consumable goods.

5. The package according to claim 1, wherein the container includes a bag.

6. The package according to claim 5, wherein the bag has a flat bottom portion.

7. The package according to claim 5, wherein the bag has a synthetic foil.

8. The package according to claim 7, wherein the synthetic foil comprises a nylon or polyester layer with a thickness of at least approximately 12 micrometers laminated to a polypropylene layer with a thickness of at least approximately 150 micrometers.

9. The package according to claim 1, wherein the container comprises:

a dish; and a cover foil extending over the dish.

10. The package according to claim 9, wherein the dish has a circular rim and the cover foil is welded to the circular rim of the dish along a circular jig seam.

11. The package according to claim 9, wherein the cover foil includes a laminate comprising a relatively thinner layer of polyester laminated to a relatively thicker layer of polypropylene.

12. The package according to claim 11, wherein the layer of polyester has a thickness of approximately 12 micrometers and the layer of polypropylene has a thickness of approximately 75 micrometers.

13. The package according to claim 9, wherein the dish comprises a thin-walled polypropylene material.

14. The package according to claim 13, wherein the thickness of the thin-walled polypropylene material is between 500 micrometers and 1000 micrometers.

15. The package according to claim 9, wherein the dish has an elastic memory.

16. The package according to claim 1, wherein the fresh, raw foods comprise raw meat and raw vegetables.

17. The package according to claim 16, wherein the raw meat comprises chicken.

18. The package according to claims 16, wherein the raw meat comprises fish.

19. The package according to claim 1, wherein the fresh, raw foods comprise zucchini and carrots.

20. The package according to claim 1, wherein the consumable goods comprise the sole source of water in the package.

21. The package according to claim 1, wherein the consumable goods are packaged with flavoring and do not require additional ingredients or water.

22. A microwave-safe package for storing and heating consumable goods in a microwave oven, comprising:

a microwave-safe container defining an interior, said container having sufficient stability to withstand heating conditions-including microwave energy, vapor pressures of up to 3 bar, and a temperature of 150° Celsius;

a one-way microwave-safe valve for venting gas from the interior, said valve venting excess gas when the pressure of the interior exceeds a first threshold pressure and said valve closing when the pressure of the interior is less than a second threshold pressure;

said valve venting gas produced during beating to prevent package rupture or damage when the pressure of the interior exceeds a first threshold pressure, wherein said valve has a well-defined flow resistance and a dimensionally stable valve gate at vapor pressures of up to 3 bar and at temperatures of up to 150° Celsius developed in the interior during heating;

said one-way valve configured to enable the vapor pressure which builds up in the package during microwave heating to escape comparatively slower from the package into the ambient atmosphere primarily due to the flow resistance of said valve such that a vapor banking situation develops inside the package such that the temperature rises above 100° Celsius and the pressure increases above ambient such that the cooking of the consumable goods occurs quickly and gently; and consumable goods disposed in the interior of the container, said consumable goods comprising of at least two different fresh, raw foods that require different cooking times in water, and said consumable goods having an amount of water content of at least 30% by weight.

23. The package according to claim 22, wherein said microwave-safe valve for venting gas from the interior vents excess gas produced during storage, which includes transportation and sale portions of time.

24. The package according to claim 22, wherein the first threshold pressure is less than 10 mb.

25. The package according to claim 22, wherein the first threshold pressure is less than 5 mb.

26. The package according to claim 22, wherein the second threshold pressure is less than approximately 0.5 mb.

27. The package according to claim 22, wherein said valve comprises a rigid valve body and a membrane secured to the rigid valve body.

28. The package according to claim 22, wherein the consumable goods are heated by vapor pressure and by absorption of radiation by water contained in the consumable goods.

29. The package according to claim 22, wherein the container includes a bag.

30. The package according to claim 29, wherein the bag has a flat bottom portion.

31. The package according to claim 29, wherein the bag has a synthetic foil.

32. The package according to claim 31, wherein the synthetic foil comprises a nylon or polyester layer with a thickness of at least approximately 12 micrometers laminated to a polypropylene layer with a thickness of at least approximately 150 micrometers.

33. The package according to claim 22, wherein the container comprises:

a dish; and a cover foil extending over the dish.

34. The package according to claim 33, wherein the dish has a circular rim and the cover foil is welded to the circular rim of the dish along a circular jig seam.

35. The package according to claim 33, wherein the cover foil includes a laminate comprising a relatively thinner layer of polyester laminated to a relatively thicker layer of polypropylene.

36. The package according to claim 35, wherein the layer of polyester has a thickness of approximately 12 micrometers and the layer of polypropylene has a thickness of approximately 75 micrometers.

37. The package according to claim 33, wherein the dish comprises a thin-walled polypropylene material.

38. The package according to claim 37, wherein the thickness of the thin-walled polypropylene material is between 500 micrometers and 1000 micrometers.

39. The package according to claim 33, wherein the dish has an elastic memory.

40. The package according to claim 22, wherein the fresh, raw foods comprise raw meat and raw vegetables.

41. The package according to claim 40, wherein the raw meat comprises chicken.

42. The package according to claim 40, wherein the raw meat comprises fish.

43. The package according to claim 22, wherein the fresh, raw foods comprise zucchini and carrots.

44. The package according to claim 22, wherein the consumable goods comprise the sole source of water in the package.

45. The package according to claim 22, wherein the consumable goods are packaged with flavoring and do not require additional ingredients or water.

46. A microwave-safe package for storing and heating consumable goods in a microwave oven, comprising:

a microwave-safe container defining an interior, said container having sufficient stability to withstand heating conditions including microwave energy, vapor pressures of up to 3 bar, and a temperature of 150° Celsius;

a one-way microwave-safe valve having a rigid valve body and a membrane secured to the rigid valve body for venting gas from the interior, said valve venting excess gas produced during heating to prevent package rupture or damage, wherein said valve has a well-defined flow resistance and a dimensionally stable valve gate at vapor pressures of up to 3 bar and at temperatures of up to 150° Celsius developed in the interior during heating;

said one-way valve configured to enable the vapor pressure which builds up in the package during microwave heating to escape comparatively slower from the package into the ambient atmosphere primarily due to the flow resistance of said valve such that a vapor banking situation develops inside the package such that the temperature rises above 100° Celsius and the pressure increases above ambient such that the cooking of the consumable goods occurs quickly and gently; and consumable goods disposed in the interior of the container, said consumable goods comprising of at least two different fresh, raw foods that require different cooking times in water, said consumable goods having an amount of water content of at least 30% by weight, wherein said consumable goods comprise the sole source of water in the package.

47. The package according to claim 46, wherein storage includes transportation and sale portions of time.

48. The package according to claim 46, wherein the consumable goods are heated by vapor pressure and by absorption of radiation by water contained in the consumable goods.

49. The package according to claim 46, wherein the fresh, raw foods comprise raw meat and raw vegetables.

* * * * *